United States Patent [19]

Tateishi

[11] Patent Number: 4,834,629

[45] Date of Patent: May 30, 1989

[54] MODULAR FAN

[76] Inventor: Arthur K. Tateishi, 25 Warrender, Apt. 202, Toronto, Ontario, Canada

[21] Appl. No.: 312,386

[22] Filed: Oct. 19, 1981

[51] Int. Cl.[4] ..... F04B 35/04; H02K 11/00

[52] U.S. Cl. ..... 417/423.1; 310/68 A

[58] Field of Search ..... 417/360, 423 R, 410, 417/361; 310/40.5, 68 A, 71, 89; 415/125, 150, 210

[56] References Cited

U.S. PATENT DOCUMENTS

| | | | |
|---|---|---|---|
| 1,975,066 | 9/1934 | Sanderson | 417/423 R |
| 2,710,717 | 6/1955 | Palmer | 417/423 R |
| 2,768,782 | 10/1956 | Tateishi | 417/361 |
| 2,836,350 | 5/1958 | Tateishi | 415/125 |
| 3,826,935 | 7/1974 | Grierson et al. | 310/71 |
| 3,829,250 | 8/1974 | Samson, Jr. | 417/423 R |
| 4,229,634 | 10/1980 | Hickman et al. | 310/68 A |
| 4,370,579 | 1/1983 | Kobayashi et al. | 310/71 |

*Primary Examiner*—William L. Freeh
*Assistant Examiner*—Paul F. Neils

[57] ABSTRACT

The present invention provides a modular fan construction in which the fan motor, with its operating controls, can be tested away from the fan housing and then fit into the housing without disassembly after the testing.

15 Claims, 8 Drawing Sheets

FIG. 7a.
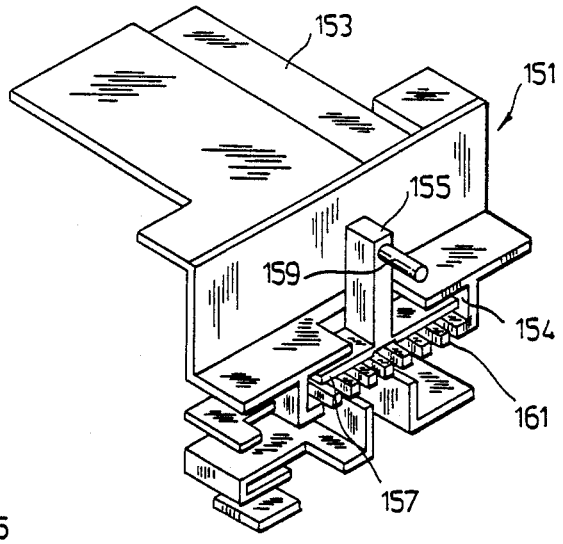
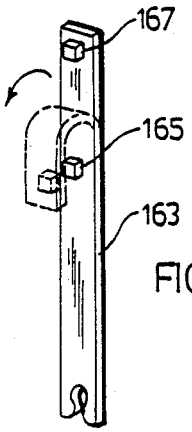
FIG. 7b
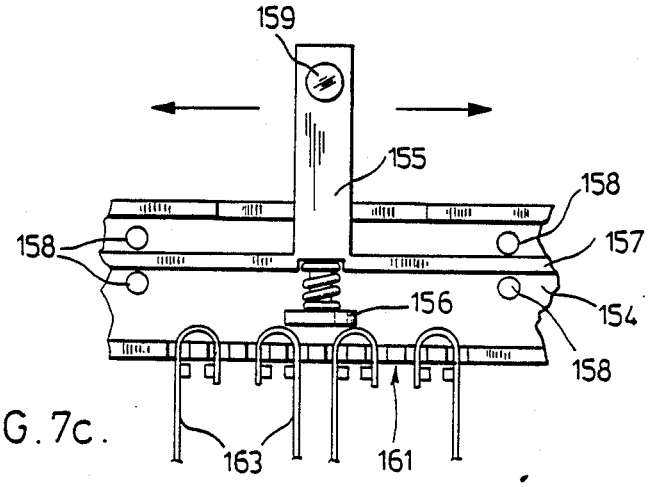
FIG. 7c.

FIG. 7.
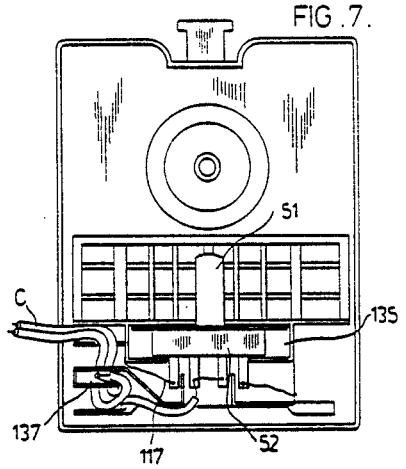
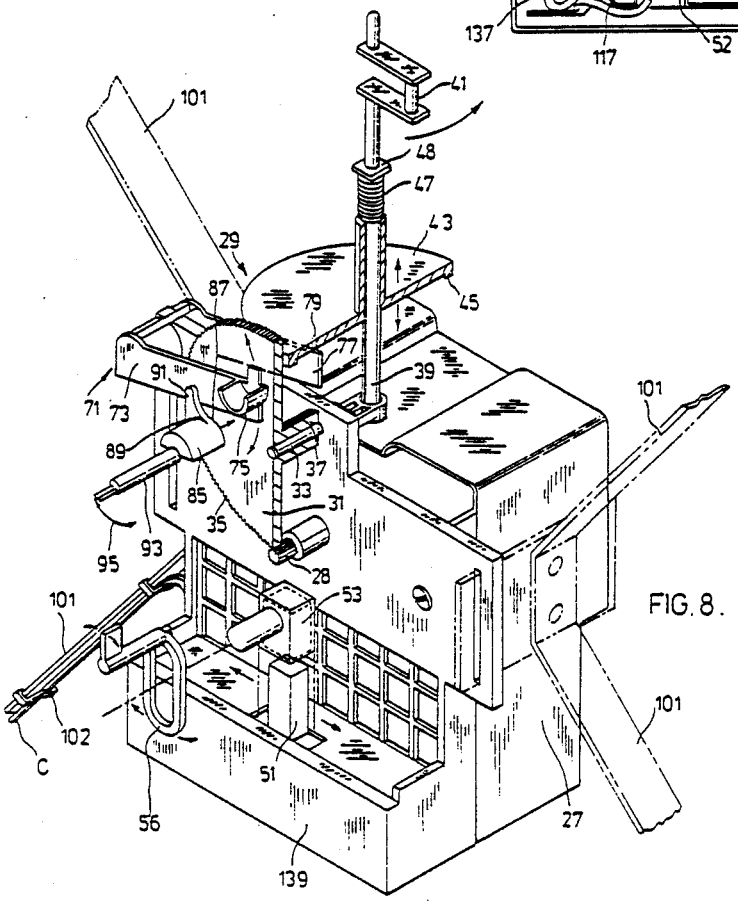
FIG. 8.

MODULAR FAN

FIELD OF THE INVENTION

The present invention relates to a modular construction for a fan in which different modules are located at predetermined positions within the fan to enable testing both prior to and after complete construction of the fan.

BACKGROUND OF THE INVENTION

According to standard construction, most fans are equipped with a fan motor at one location within the fan and a plurality of controls for the motor at a different location within the fan. The controls are then wired through the fan housing to the fan motor. In some arrangements where there are numerous controls, such as those required in an oscillating fan, the wiring can get quite complicated and involved and it is only after the fan has been fully assembled that the operation of the controls for the motor can be tested. If the motor is not operational, then the entire fan structure must be disassembled and then reassembled to again check the motor. If the motor does not work in the second instance, this entire process must be repeated.

SUMMARY OF THE INVENTION

The present invention provides a modular arrangement for use in an electric fan whereby the fan motor is operable independently of the fan housing. The modular arrangement includes a switch mounting module for mounting an electrical switch at the motor for connection to the motor coil and retaining means for retaining the switch mounting module and the electrical switch with the motor. The use of the switch mounting module fitted to the motor and carrying an electrical switch allows testing of the motor away from the housing with the housing being arranged to receive the motor such that the electrical switch is automatically fitted into a control position at the housing.

According to an aspect of the invention the switch mounting module further includes a plate portion which both locates the switch mounting module in position at the motor and assists in insulating the coil of the motor from the remainder of the motor body. The switch mounting module may further be provided with a cord wind region for essentially isolating the electrical connections at the switch from tensions placed on the electrical cord of the motor.

According to a further aspect of the invention the fan includes an oscillating louvre arrangement prefitted at the fan housing and a drive system for the oscillating louvre arrangement at the fan motor. The modular construction of the fan is again arranged such that the drive system is automatically fitted with the controls for the oscillating louvre blade arrangement when the fan motor is received within the fan housing also enabling testing of the drive system prior to assembly of the fan.

BRIEF DESCRIPTION OF THE DRAWINGS

The above as well as other advantages and features of the present invention will be described in greater detail according to the detailed description of the preferred embodiments of the present invention in which:

FIG. 7 is a front plan view showing the motor of FIG. 6 partially assembled;

Figure 6:
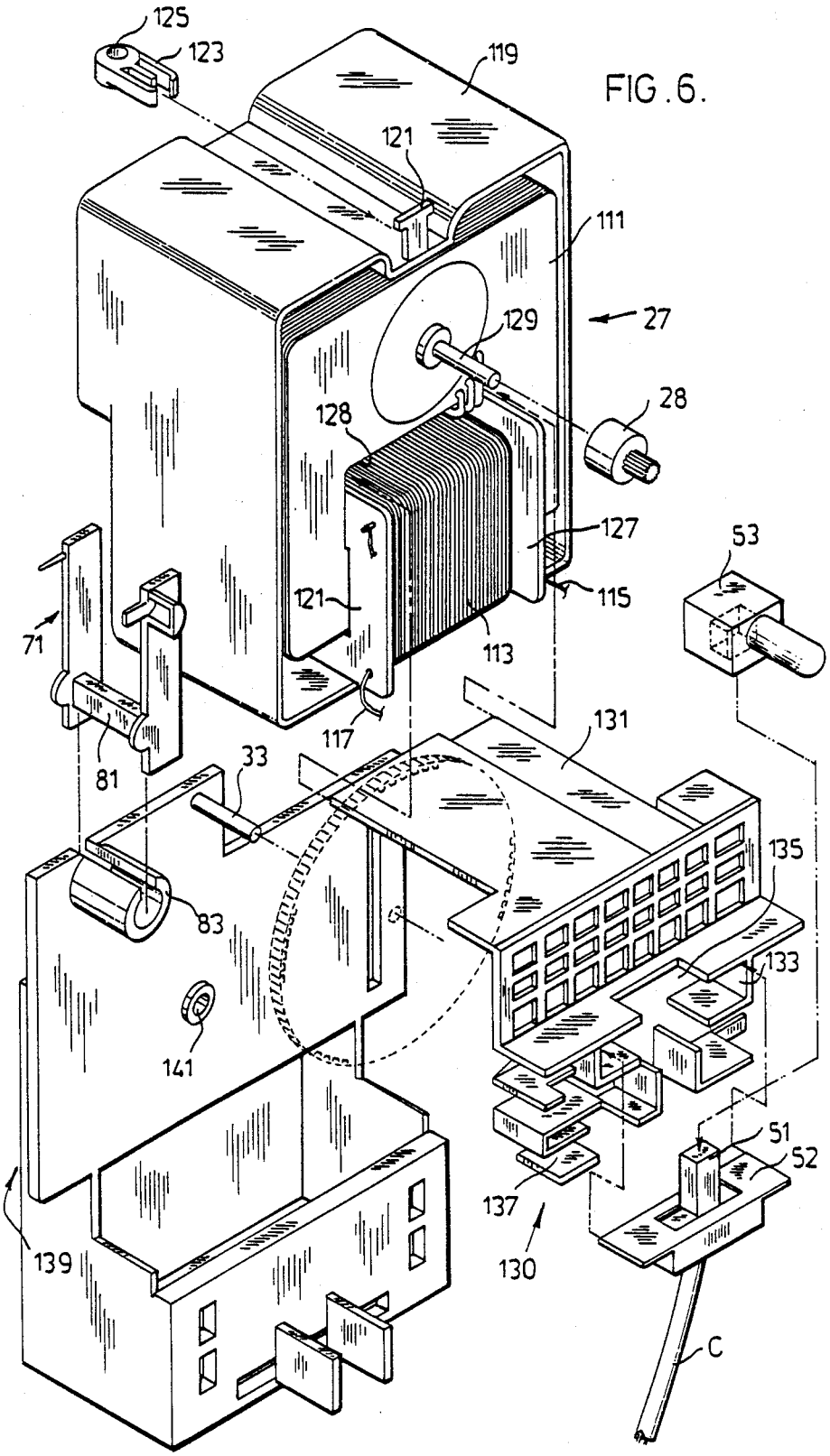
FIG. 6 is an exploded perspective view of the motor for operating the fan structure of FIG. 1.

FIG. *7a* is a perspective view looking down on an alternate preferred form of a switch mounting module from that shown in FIGS. 6 and 7;

FIG. *7b* shows in perspective a terminal connection for use with the module of FIG. *7a;*

FIG. *7c* is a front plan view of the terminal when bent to the dotted line position of FIG. *7b* and fitted into the module of FIG. *7a;*

Figure 1:
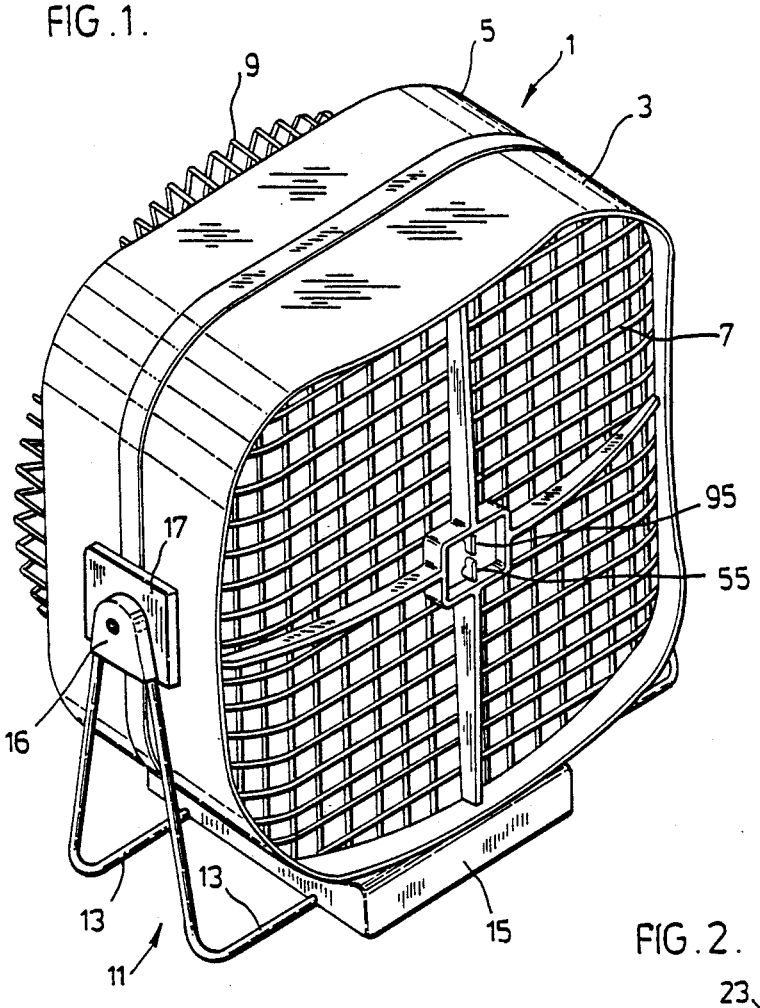
FIG. 1 is a front perspective view looking down on a fan construction according to a preferred embodiment of the present invention.
Figure 9:
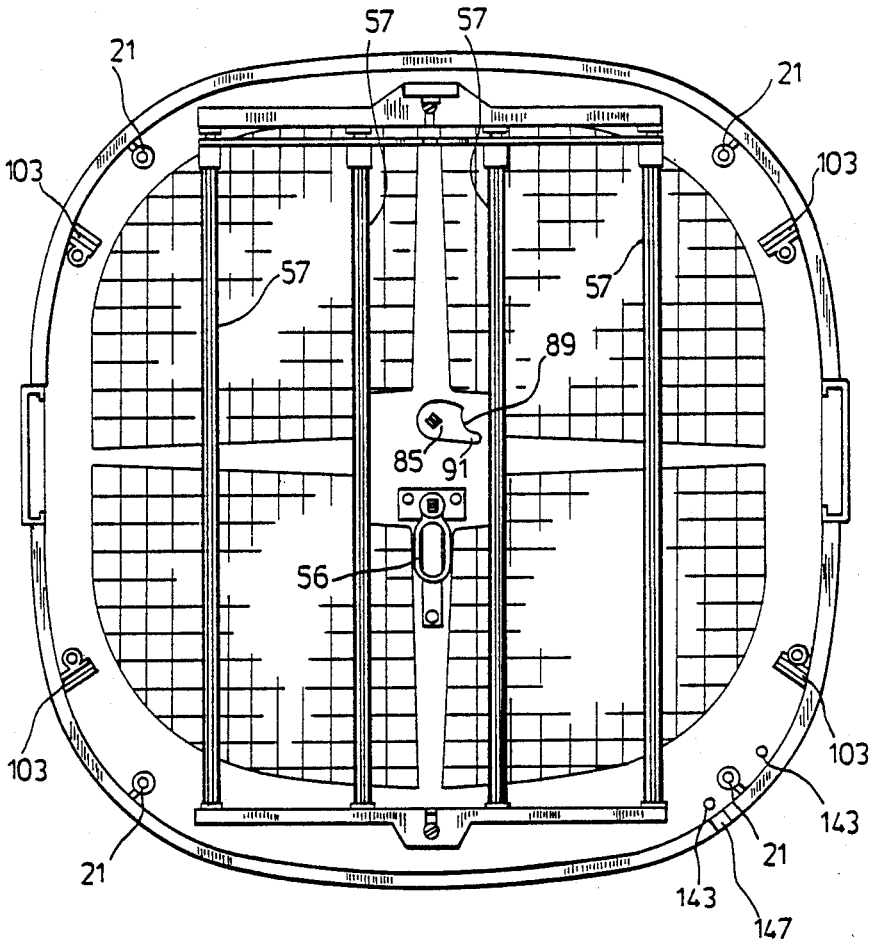
Figure 10:
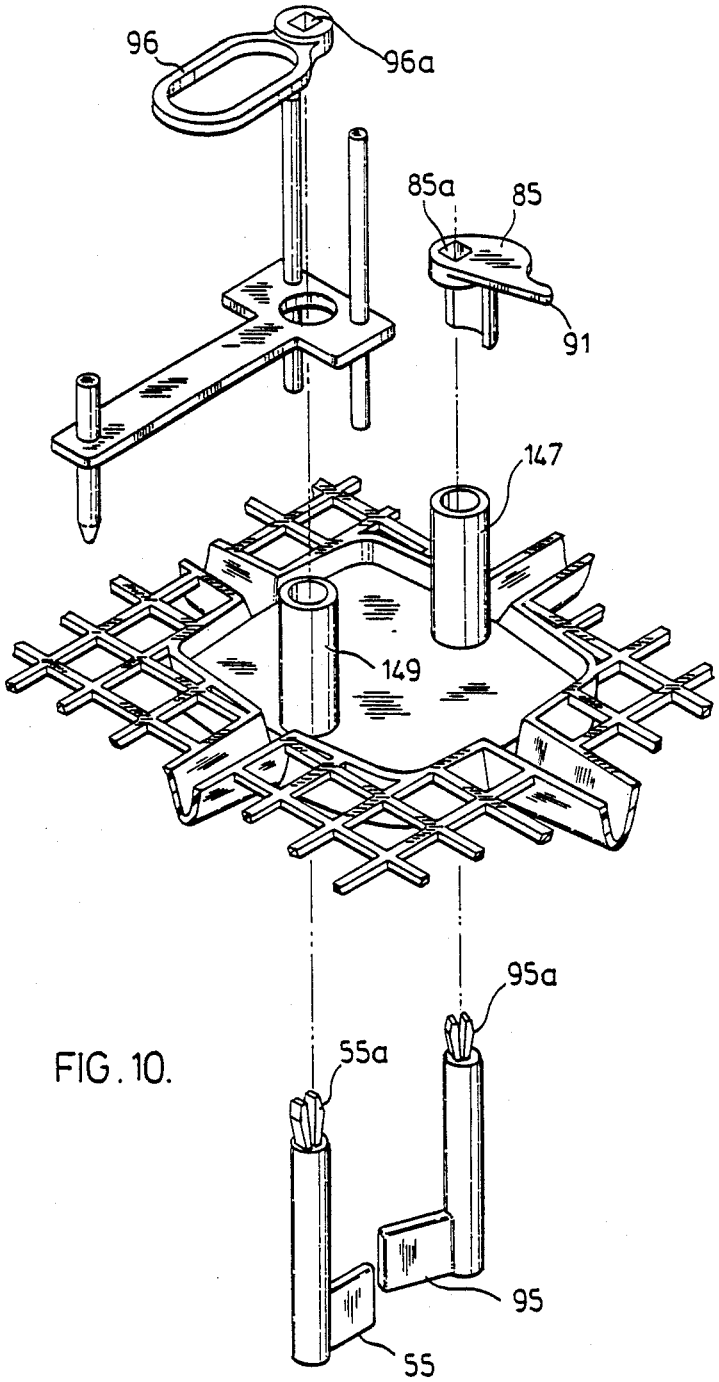

FIG. 8 is a front perspective view showing the motor of FIG. 6 when fully assembled;

FIG. 9 is a rear plan view of the forward housing portion of the fan structure of FIG. 1; and FIG. 10 is an enlarged perspective view through the central area of the housing portion shown in FIG. 9.

DETAILED DESCRIPTION OF THE PREFERRED EMBODIMENTS

Figure 2:
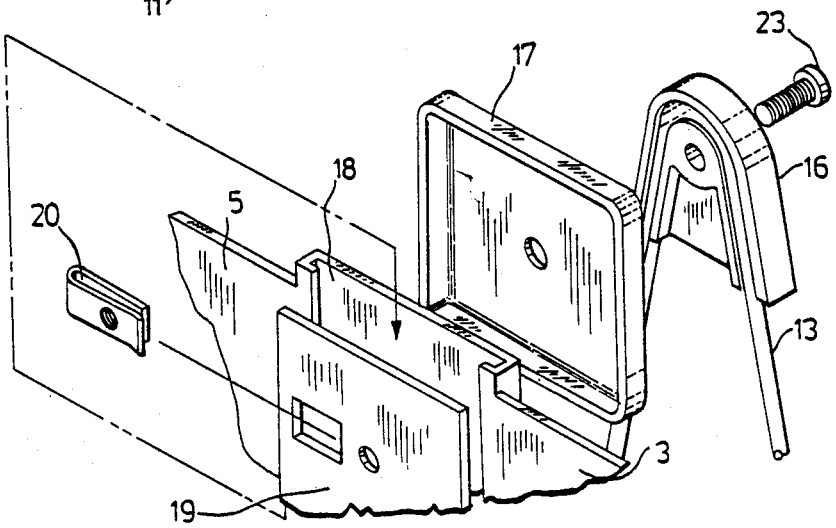
FIG. 2 is an exploded perspective view showing in partial section the connection of the stand to the fan housing of the structure shown in FIG. 1.
Figure 3:
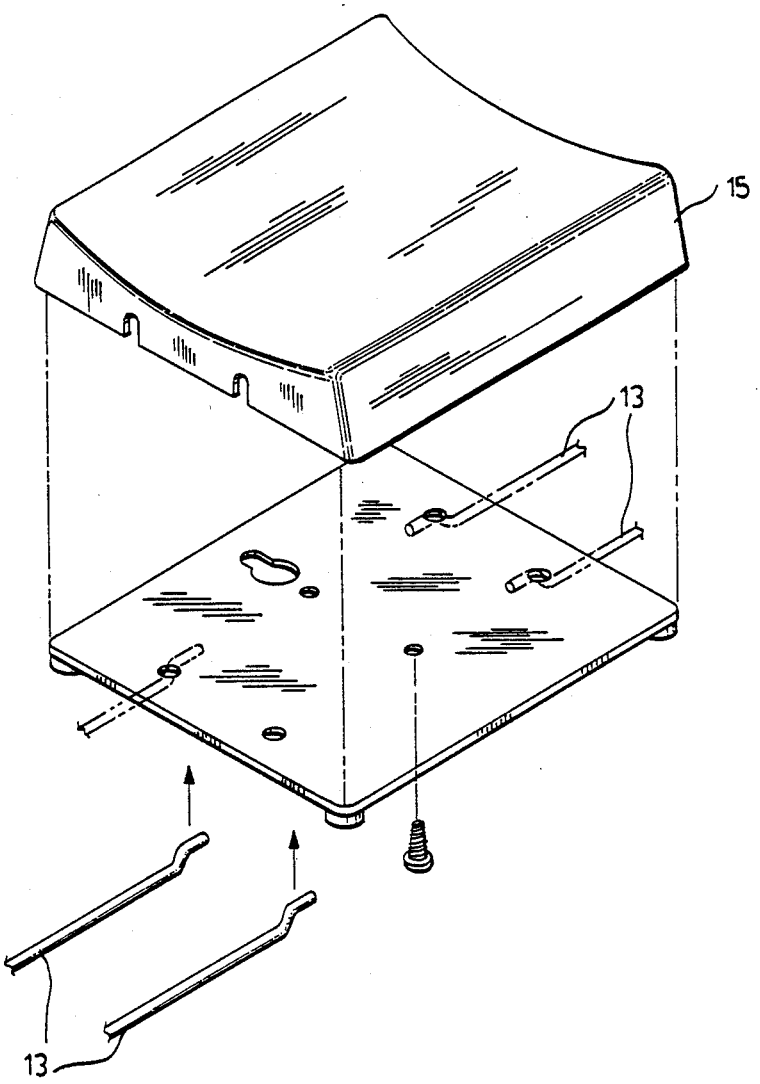
FIG. 3 shows in perspective an exploded view of the base of the stand for the fan of FIG. 1.
Figures 4, 5:
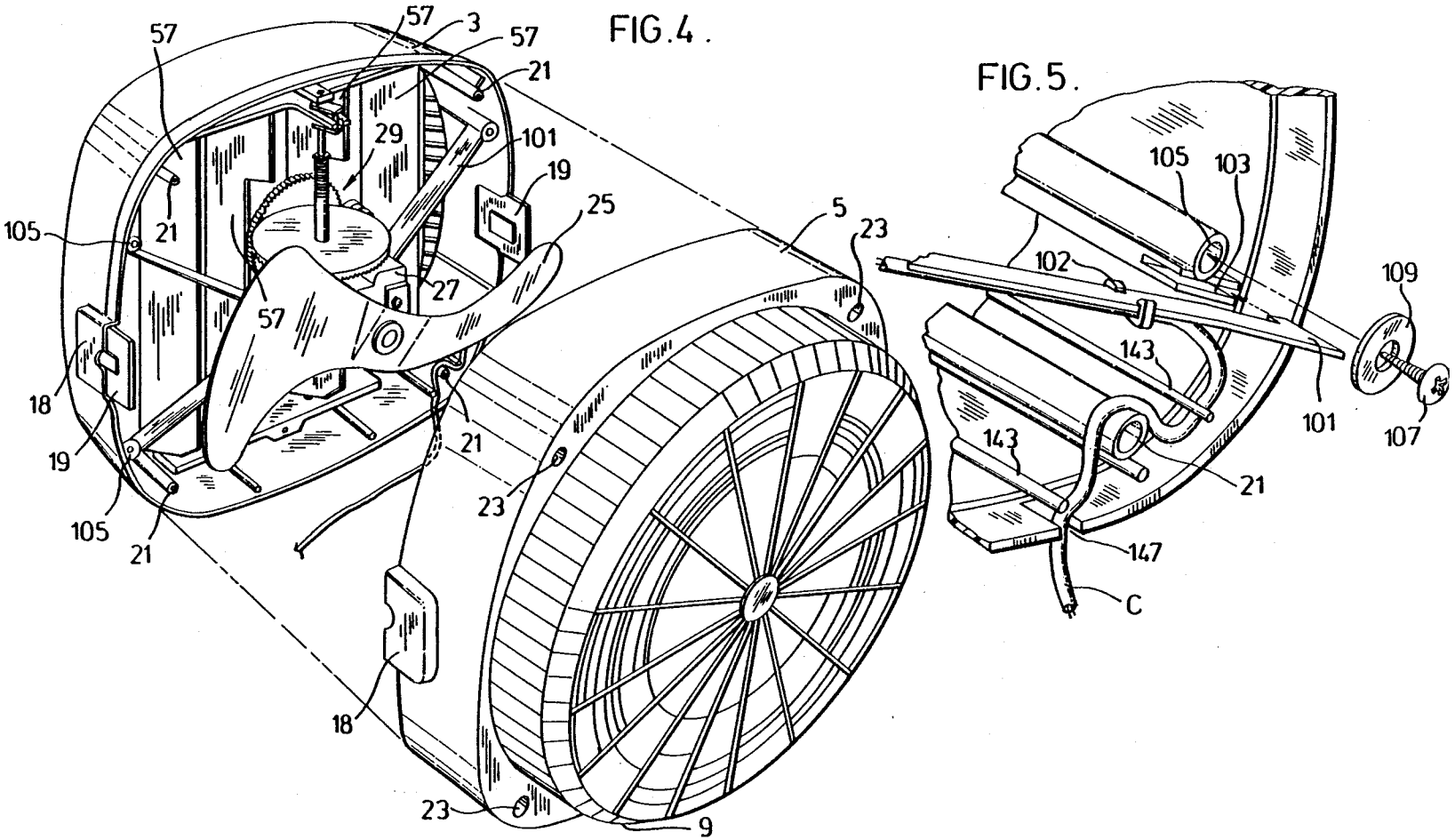
FIG. 4 is a partially exploded rear perspective view of the fan housing of FIG. 1.
FIG. 5 shows in perspective an enlargement of one of the corner regions of the fan housing shown in FIG. 4.

As shown in the Figures, a preferred form of a fan of the present invention is provided with co-operating modules throughout the entire structure which is broken down into three main areas; namely the interior assembly best shown in FIGS. 6 and 8, the housing for receiving the interior assembly, best shown in FIGS. 1, 5 and 9, and the fan stand best shown in FIGS. 1, 2 and 3. The interior assembly which will be described later in detail is built separately from the housing which is adapted to receive the interior assembly as described below.

As shown in FIG. 1, an assembled fan generally indicated at 1 is supported by means of a stand 11. Both the fan and its stand include a plurality of modules which are preset to cooperate with one another in forming the overall arrangement.

The housing for the fan comprises a forward housing portion 3 and a rearward housing portion 5. The forward housing portion is provided with a grill 7 and the rearward housing portion is provided with a grill 9. A pair of switches 55 and 95, prefitted to the housing, are exposed at the forward housing portion for operation of the fan, as described later in detail.

The stand in secured to the side of the fan housing, as best shown in FIG. 2. The two housing portions are formed to cooperate with one another in forming an outwardly extending rectangular portion 18 having an interior plate receiving region adapted to receive plate 19. A exterior plate 17 is adapted to fit over the outward projection at the side of the fan housing.

The stand itself is formed from a base portion 15 with legs 13 locked into the base portion, as shown in FIG. 3, and extending upwardly to the side of the fan, as shown in FIGS. 1 and 2. The stand legs are fitted with a collar 16 for receiving threaded bolt 23 which fits through the collar as well as exterior plate 17 and interior plate 19 to lock into a tinnerman nut 20 fixed to plate 19.

As will be appreciated from an analysis of FIGS. 2 and 3, the legs and the base of the stand are easily fitted to one another and can be readily disassembled by simply removing bolts 23 from the side of the fan housing to enable the legs to be pulled away from the base, when desired, for shipping and the like.

FIG. 4 shows the forward and rearward housing portions separated from one another. These two housing portions are secured to one another by means of threaded studs 21 on the forward housing portion which are fitted into openings 23 on the rearward housing portion and held in position by threaded bolts not shown in the drawings.

It will be seen that this particular fan is adapted for multidirectional control of the air drawn from the back of the fan by fan blade 25, operated from motor 27 and blown outwardly through the front grill. Motor 27 is set up to reciprocate a plurality of louvre blades 57 through a control mechanism generally indicated at 29. The oscillation drive is described in conjunction with motor 27 below.

The fan motor and the operating controls for the fan motor are shown in fully assembled form in FIG. 8. This entire package of components is held to the forward housing portion by means of supporting arms 101 secured to either side of the motor body casing 119. The securing of the arms 101 to the housing is best shown in FIGS. 4 and 5, where each arm is adapted to slide into a cooperating groove 103 adjacent threaded studs 105. The arms 101 are held within grooves 103 by means of screws 107 threaded into studs 105 and carrying washer like members 109 adapted to override and lock the arms 101 in position. Therefore, the entire fan assembly can be removed from forward housing portion 3 by removing all of the screws 107 and sliding arms 101 out of their respective securing grooves. From the same standpoint, the fully assembled motor is just as easily fit back into the forward housing portion due to the automatic positioning of the motor by simply fitting arms 101 into grooves 103.. It should be noted in FIG. 4 that the two middle louvre blades 57 are centrally recessed to allow the fully assembled motor unit to simply slide into position in the housing without interfering with the oscillation of these two louvre blades.

The motor package or interior assembly of FIG. 8 is broken down into a plurality of different components adapted to cooperate with one another, as described immediately below.

The motor itself comprises a metallic body portion 111 carrying a coil 113 wound on a bobbin 127. Coil 113 has exposed primary and secondary windings 115 and 117. The sides of the coil are insulated from the metallic body portion by means of the insulating side plates of the bobbin to either side of the coil. Both the body portion 111 and the coil 113 are protected by means of the outer casing 119. The casing is provided with an upwardly extending T-shaped stud 121 adapted to removably secure clip-on member 123 provided with an apertured portion 125. Extending from the front of the body portion of the motor is a rotary shaft 129 for receiving a geared shaft cap 28.

The motor is adapted to receive a switch mounting module 130 which includes both an insulating plate portion 131 and a switch receiving region 133 for receiving an electrical switch body 52. Switch receiving region 133 is cut away as indicated at 135 to accommodate a sliding on/off and speed control member 51 of switch 52.

Module 130 is adapted to fit directly to the motor 27 by sliding the insulating plate portion 131 of the module into gap 128 between body portion 111 and coil 113 of the motor. The cooperation between the module and the motor is such that the coil and the metallic body portion of the motor are insulated from one another by the insulating plate, while at the same time the switch receiving region is placed immediately adjacent coil 113 between the side plates of bobbin 127 at the coil. Accordingly, switch body 52, when fit into the switch receiving region, is located for immediate connection to the primary and secondary windings of the coil as best shown in FIG. 7.

Switch receiving region 133 of module 130 is further provided with a cord wind portion 137. This cord wind portion enables a back and forth winding of cord C into the module, where the cord is connected directly to the downwardly extending terminals on the bottom of switch 52. Furthermore, due to this cord winding, stresses on the cord are taken up by module 130, so that there is essentially no pull at the connection between the cord and the switch. This, of course, is extremely beneficial in that regardless of how much tugging is done on cord C, it is not likely to break the electrical connection to switch 52.

After module 130 and switch 52 have been fitted into the FIG. 7 position, in which the motor and the switch are combined as a single unit, a cover plate 139 is fit over the front of the unit and bolted to the motor to hold the unit together.

In the embodiment described above, module 130 and switch body 52 are built separately from one another. According to a further embodiment as shown in FIGS. 7*a* through 7*c*, a switch module 151 is set up to build a switch into the module. Module 151 includes an insulating plate 153 and a switch receiving region 154 which is provided with a slotted plate 161 for receiving terminals 163 as shown in FIG. 7*c*. Each of the terminals has a pair of lugs 165 and 167 which face one another when the terminals are bent to the FIG. 7*b* dotted line position. The terminals are then slipped onto the slotted plate where the inwardly facing lugs lock the terminals against up and down travel off of plate 161. A switch member having an upright stem 155 provided with forward extension 159, a base plate 157 and a spring loaded electrical contact 156 is fitted into region 154 to slide over terminals 163 to make different electrical connections for turning the fan on and off at different fan speeds. Region 154 is provided with locator pins 158 for properly positioning the base plate of the switch in the module with the entire arrngement then being covered by plate 139 to hold the switch and terminals in the module.

Turning now to the drive system for the louvre blade oscillation cover plate 139 is provided with opening 141 through which shaft 129 is fitted for receiving geared cap 28. Cover 130 is itself provided with a shaft portion 33 immediately above opening 141. A geared wheel 31 is adapted to slide onto shaft 33 and mesh with gear 28, as shown in FIG. 8. The cover also includes a slotted housing portion 83 for receiving a bifurcated member 71 having a base portion 81 for fitting into housing portion 83. Bifurcated member 71 is fitted to the housing portion after wheel 31 has been slid onto shaft 33 and fixed in position by a small retaining clip not shown in the drawings. Through gravity the bifurcated member will automatically assume the FIG. 8 position so that no locking components are required to hold it within housing portion 83.

The oscillating louvre blades are operated from the motor by means of an elongated rotatable shaft 39 provided at its upper end with a crank portion 41. Fitted over the lower portion of shaft 39 is a further drive wheel 43 having a geared periphery 45 for rotating the shaft. Located immediately above wheel 43 is a spring 47 trapped upwardly by means of stop member 48. After wheel 43 has been slid onto shaft 39, the shaft is then fit into the apertured portion 125 of clip-on member 123 atop the motor casing.

The package shown in FIG. 8 can be completely tested for both motor and drive system operation away from the fan housing. Sliding switch member 51 is accessibly located at the front of the package and held in position by means of cover portion 139 to turn the motor on and off for rotating fan blade 25 at different speeds. At the same time, geared cap 28 is rotated at the front of the motor and meshes with geared surface 35 of wheel 31. Wheel 31 is provided with a further geared surface 37 immediately about shaft 33. This geared surface is adapted to engage geared surface 45 of wheel 43 biased downwardly by means of spring 47, when bifurcated member 71 is in a down position. The rotation of wheel 43, in turn, produces rotation of shaft 39 to rotate crank arm 41. This crank arm is adapted to easily fit into a sliding bracket arrangement at the upper end of the louvre blades for oscillation of the blades when the crank arm is rotating.

If there are any problems with the on or off control for the motor or the geared connections for rotating shaft 39, these problems are sorted out prior to assembling the entire fan so there is no need to dismantle the entire fan in order to determine the cause of the problem. If there are no problems at the motor, then the entire package, as shown in FIG. 8, is simply fit into the forward portion 3 of the fan housing. The positioning for the motor is automatically determined by means of arms 101 secured at the side of the motor casing which, as described above, fit directly into slots 103, where they are locked in place by means of washers 109.

It should be noted in both FIGS. 5 and 8 that the cord C is held by means of a clip 102 to one of the arms 101 to automatically locate the cord at a cord lock region in the housing while the motor and its controls are being fitted to the housing. This cord lock region comprises a triangular stud arrangement including a pair of small studs 143 adjacent one of the posts 21 on the forward housing. The cord is weaved through this triangular stud arrangement and out of the housing through recess 147, as best shown in FIG. 5. With this arrangement, tension on the cord is absorbed by the housing. At the same time the cord is locked against being pushed inwardly into the fan blade to meet safety requirements.

The forward housing portion also has a modular construction for automatically receiving the on/off switch and drive system fitted at the motor which, as mentioned above, move to preset positions within the housing when arms 101 are received in the slotted portions 103.

The construction of the forward housing portion is best shown in FIGS. 9 and 10. The oscillation control member 95 fits directly through collar 147 at the front of the fan and carries a bifurcated springy lock **95*a* to lock in the receiving portion 85*a* of a cradle member 85. The exterior on/off motor control 55 fits through collar 149 at the front of the fan, such that bifurcated locking portion 55*a* locks into lock receiving portion 96*a* of a loop member 96 at the inside of the forward housing portion. As will be appreciated from FIG. 10, controls 55 and 95 are quickly and easily snapped into position on the fan housing where they are releasably secured by their respective locking portions 55*a* and 95*a*. Should the controls be damaged, they can be released by simply compressing the locking portions to move them out of locking engagement with cradle member 85 and loop portion 96**, which are themselves automatically held in position by means of the exterior controls.

When the motor is placed in the forward housing portion, switch extension 53 fitted directly over switch member 51 (or switch extension 159 of the FIG. **7*a* embodiment), automatically aligns with and is located within loop 96 which is set in the FIG. 9 position to receive the switch extension in the off position. The exterior control 55 can then be moved from side to side to turn the motor off and on at different fan speeds. At the same time, the semicircular extension 75, provided on the forward arm 73 of bifurcated member 71, is automatically located immediately above cradle member 85 at the interior end of shaft 93 from control member 95. Cradle member 85 is provided with a seat portion 89 which, when rotated to the FIG. 8 position, cams beneath extension 75 of bifurcated member 71 to lift the bifurcated member upwardly such that a pin 79 provided on the rearward arm of member 71 drives upwardly to lift wheel 43 away from wheel 31 for turning off the oscillation of louvre blades 57. Cradle member 55 is provided with a stop portion 91 to prevent overrotation of the cradle with respect to extension 75 on the bifurcated control 71** for the louvre operation.

After the motor has been fitted into the forward housing portion, the rearward housing portion is then secured in position. When the two housing portions have been assembled, the stand is secured to the fan housing. The stand itself has a modular construction, so that in the event of damage to any of the stand components, it can quickly and easily be repaired without having to dismantle the entire structure.

As will be seen from the above, very few tools are required to either assemble or disassembly the structure, which includes numerous components adapted to either slide or snap into predetermined positions throughout the fan. Furthermore, the bulk of the components within the fan are molded from lightweight plastics material enabling mass production at a very low cost per unit. Accordingly, most of the components within the fan can be replaced without having to send the fan in for service and the fan and its stand can be dismantled for storage. As an added benefit, the use of plastic throughout most of the fan keeps the weight of the structure to a minimum.

Although various preferred embodiments of the invention have been described herein in detail, it will be understood by those skilled in the art that variations maybe made thereto without departing from the spirit of the invention or the scope of the appended claims.

The embodiments of the invention in which an exclusive property or privilege is claimed are defined as follows:

1. A motor operated fan formed from a plurality of independent modules adapted to cooperatively mate with one another upon assembly of said fan which comprises an interior arrangement within a modular housing and including a switch mounting module for removably mounting an electrical switch at the motor for connection of the switch to a coil of the motor to test the motor and switch away from said modular housing and for dismantling of the switch and motor to effect repairs thereto in the event of problems during such testing, said modular housing being adapted to receive said interior arrangement, said modular housing being provided with a manual control to the exterior thereof and including guide means for guiding locating of said interior arrangement therein such that said electrical switch is fitted with said manual control for operation of said fan.

2. A motor operated fan as claimed in claim 1 wherein said switch mounting module is provided with a slotted plate for receiving a plurality of electrical terminals and including a sliding contact member for sliding over said electrical terminals.

3. A motor operated fan as claimed in claim 1 including a modular stand adapted to fit to said housing.

4. A motor operated fan as claimed in claim 3 wherein said stand comprises a base portion and a pair of legs fitted into said base portion, said base portion and said legs being locked with one another when said stand is secured to said housing and being separable when said stand is removed from said housing.

5. A motor operated fan as claimed in claim 1 wherein said switch mounting module is provided with an upper, rearwardly extending plate portion for insulating the coil of said motor.

6. A motor operated fan as claimed in claims 1 or 4 wherein said switch mounting module includes a cord wind region for relieving said electrical switch from tensions on an electrical cord wound through said cord wind region.

7. A motor operated fan as claimed in claim 1 including an oscillating louvre blade arrangement prefitted to said housing and a drive system for said oscillating louvre blade arrangement with said housing being arranged such that when said motor is located in said housing, said drive system is fitted to a control position at said housing for said oscillating louvre blade arrangement.

8. A motor operated fan as claimed in claim 2 including a shaft with a crank arm for connecting said drive system to said louvre blade arrangement, said shaft being automatically trapped in an operating position when said motor with said drive system is fitted into said fan housing and being readily releasable from said operating position for removal of said fan motor and drive system from said housing.

9. A motor operated fan as claimed in claims 1 or 2 including a motor casing and a plurality of arms extending outwardly from said motor casing, said fan housing being provide with slotted regions for receiving said arms to automatically locate said motor when fitted into said housing.

10. A motor operated fan as claimed in claim 7 including a first switch control module and second drive system control modules fitted to said fan to mate with said electrical switch and said drive system respectively when said motor is fitted into said housing.

11. A motor operated fan as claimed in claim 10 including a loop member control module prefitted to said housing and adapted to mate with said electrical switch when said fan motor is fitted into said housing.

12. A motor operated fan as claimed in claim 10 wherein said first and second control modules both include bifurcated springy lock portions for releasably locking said control modules to said fan housing.

13. A motor operated fan as claimed in claim 10 including a lift control cradle member prefitted to said fan housing and adapted to mate with said drive system when said motor is fitted into said housing.

14. A motor operated fan as claimed in claim 13 including a removable cover member for removably retaining said switch mounting module at the fan motor.

15. A motor operated fan as claimed in claim 14 wherein said cover member is provided with a projecting shaft portion for receiving a drive wheel of said drive system and a slotted housing portion for receiving a bifurcated lift member operated by said lift control cradle member.

* * * * *